US006322397B1

(12) United States Patent
Zhang

(10) Patent No.: US 6,322,397 B1
(45) Date of Patent: Nov. 27, 2001

(54) MINIATURIZED POWER JACK WITH HIGH NORMAL FORCE

(75) Inventor: Guohua Zhang, KunShan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/684,265

(22) Filed: Oct. 6, 2000

(30) Foreign Application Priority Data

May 16, 2000 (TW) ..... 089208224

(51) Int. Cl.[7] ..... H01R 24/04
(52) U.S. Cl. ..... 439/668; 439/188; 439/944
(58) Field of Search ..... 439/668, 188, 439/101, 108, 944

(56) References Cited

U.S. PATENT DOCUMENTS 4,894,026 * 1/1990 Dixon et al. ..... 439/609
6,000,970 * 12/1999 Wu ..... 439/669
6,077,126 * 6/2000 Peng ..... 439/668
6,220,898 * 4/2001 Wu ..... 439/668
6,227,889 * 5/2001 Wu ..... 439/188

* cited by examiner

*Primary Examiner*—Gary Paumen
*Assistant Examiner*—Truc Nguyen
(74) *Attorney, Agent, or Firm*—Wei Te Chung

(57) ABSTRACT

A power jack (1) comprises a housing (10), a conductive pin (40) extending longitudinally through a first chamber (121) of the housing, two contacts (20), (30) functioning as a switch and received in the housing, and a spring member (50) received in a second chamber (123) which is located below and in communication with the first chamber. The spring member includes a planar base (51) secured in the second chamber and a resilient finger (53) protruding into the first chamber. The finger provides an engaging section (54) at a free end thereof for pressing against an inserted complementary connector (200), thereby increasing a normal force applied by the power jack on the complementary connector. The spring member establishes only a mechanical connection with the complementary connector. An arm (34) of the contact (30) also exerts a force against the complementary connector, further increasing the normal force between the power jack and the complementary connector. This ensures secure retention of the complementary connector in the power jack.

1 Claim, 7 Drawing Sheets

MINIATURIZED POWER JACK WITH HIGH NORMAL FORCE

BACKGROUND OF THE INVENTION

1. Field of the Invention

The present invention relates to a miniaturized power jack connector, and particularly to a miniaturized power jack connector with high insertion force.

2. Brief Description of the Prior Art

With the miniaturization of electrical connectors, providing terminals creating a normal force large enough to securely retain a plug connector in a complementary receptacle connector becomes a problem. The terminals of a miniaturized connector do not generally provide a large enough normal force. The need to miniaturize and the need for suitably large normal forces have generated a variety of attempted solutions to this problem.

U.S. Pat. No. 4,894,026 discloses a conventional receptacle connector comprising a conductive shield which surrounds a dielectric housing. The housing defines a receiving cavity for receiving a plug connector, and the shield forms a resilient finger extending into the receiving cavity for engaging with a shield of the plug connector. The finger contacting with the shield of the plug connector increases the normal force between the connectors, and establishes an electrical path between the shield of the plug connector and the shield of the receptacle connector.

However, in some applications, electrical connection between the shield of the plug connector and the shield of the receptacle connector is undesired, particularly when the connector does not need a shield. In such cases, a connector is desired which provides a high normal force without an electrical connection between the shields of the plug connector and the receptacle connector.

Hence, an improved electrical connector is required to overcome the disadvantages of the prior art.

BRIEF SUMMARY OF THE INVENTION

An object of the present invention is to provide a miniaturized power jack which exerts high normal force on a complementary connector;

Another object of the present invention is to provide such a jack whereby shield to shield contact is not necessary.

To achieve the above-mentioned objects, a power jack of the present invention includes a housing, a conductive stationary switch contact located at a rear end of the housing, a pin longitudinally extending along the housing, a moveable switch contact, and a spring member positioned under the pin.

The housing defines a first chamber extending inward from a front surface of the housing, a second chamber located below and communicating with the first chamber for receiving the spring member, a third chamber defined in a rear end of the housing for receiving the stationary switch contact, and a fourth chamber located lateral to and communicating with the first chamber for receiving the moveable switch contact.

The pin provides a contacting section extending along the first chamber, a securing section fixed in the housing, and a solder tail.

The stationary switch contact and the movable switch contact cooperate to function as an electrical switch.

The spring member includes a planar base secured in the second chamber and a resilient finger protruding from the second chamber into the first chamber for pressing against an inserted complementary connector. The spring member provides a mechanical connection between the inserted complementary connector and the power jack, without an electrical connection therebetween. Therefore, the spring member increases the normal force between the power jack and the complementary connector for maintaining the inserted complementary connector in position and ensuring a reliable electrical connection between the inserted complementary connector and the pin of the power jack.

Other objects, advantages and novel features of the present invention will become more apparent from the following detailed description of the present embodiment when taken in conjunction with the accompanying drawings.

DETAILED DESCRIPTION OF THE INVENTION

Figure 1:
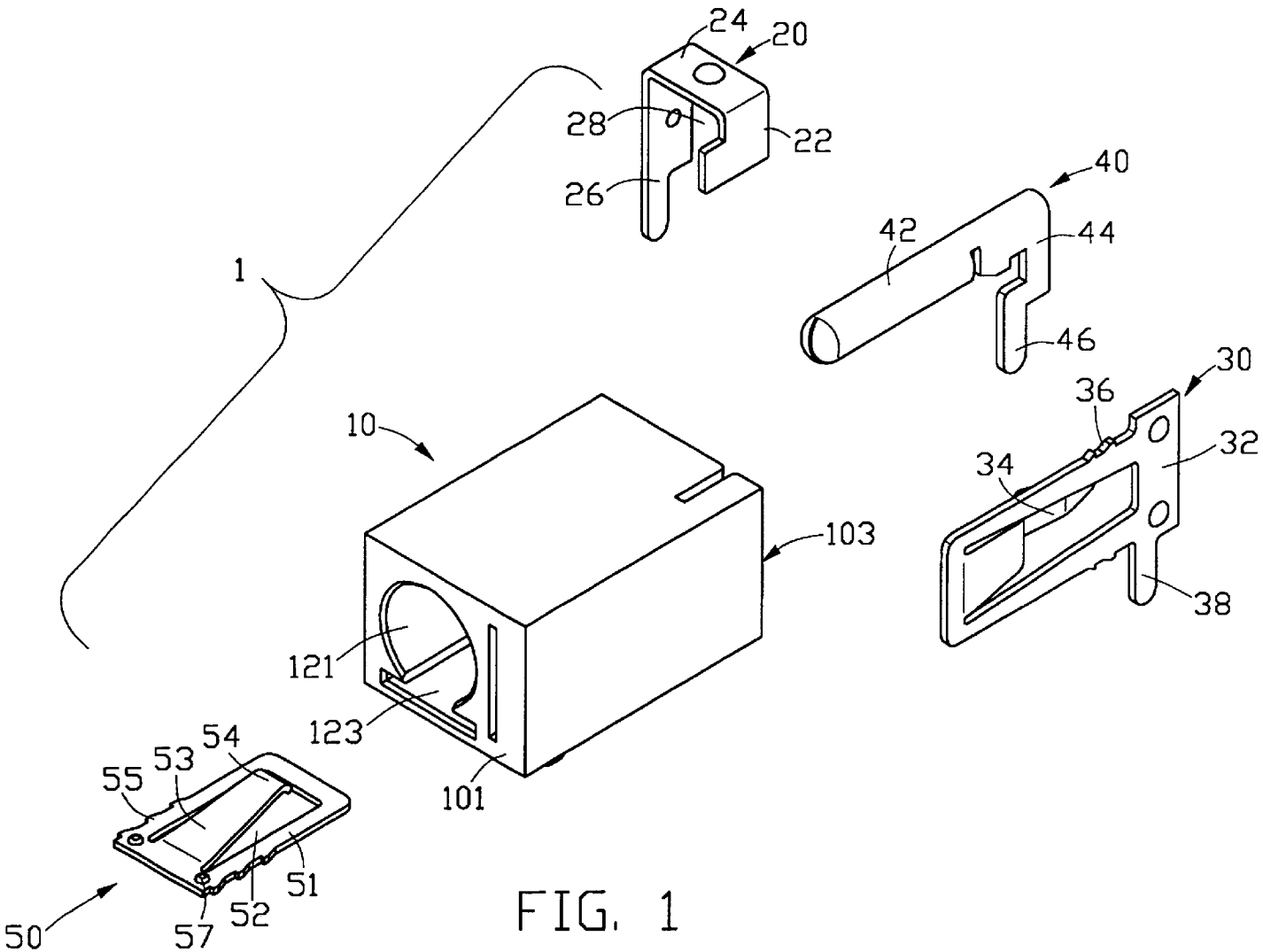
FIG. 1 is an exploded view of a power jack of the present invention.
Figure 2:
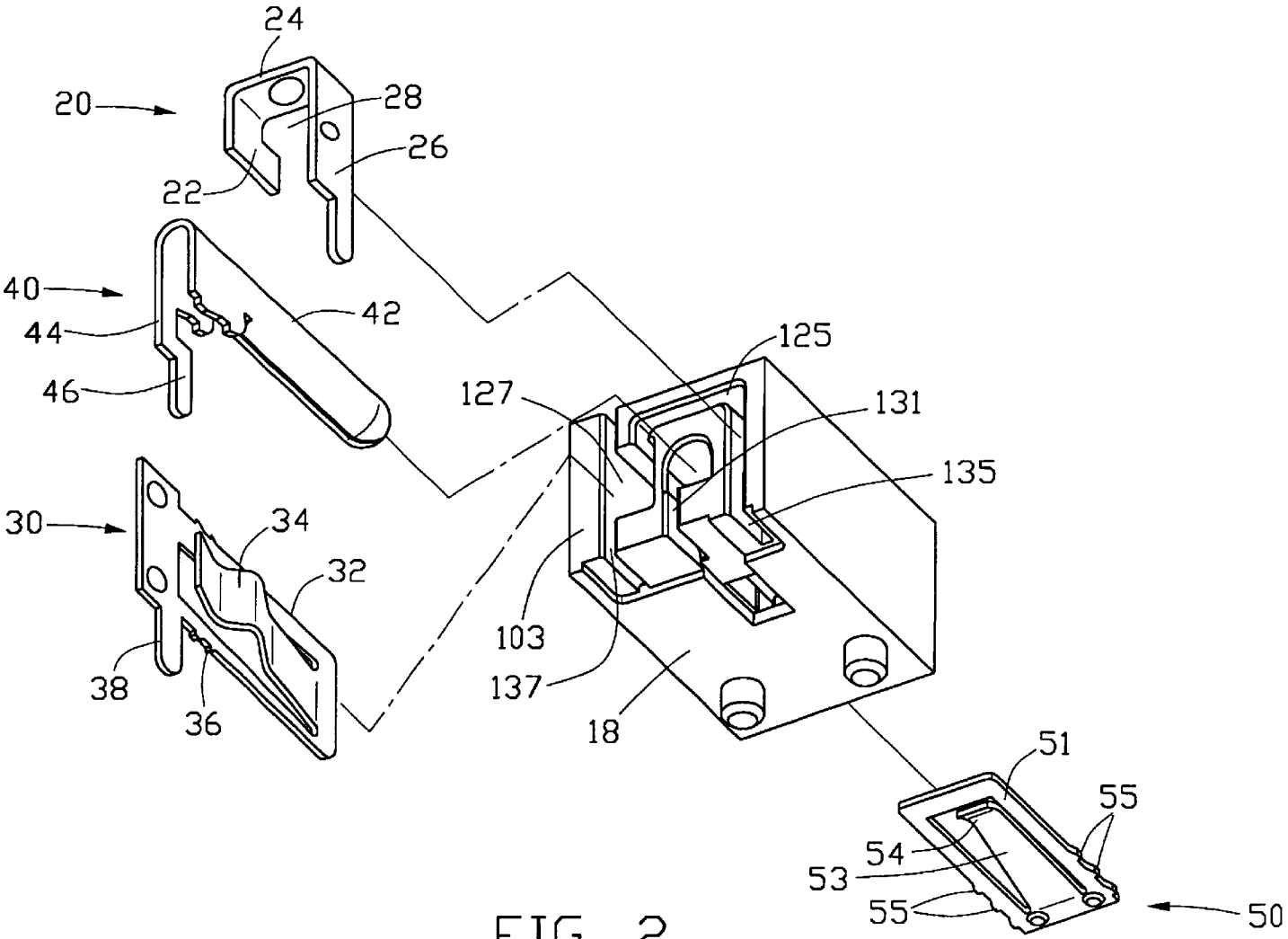
FIG. 2 is a view similar to FIG. 1 viewed from a different angle.

Referring to FIGS. 1 and 2, a high normal force power jack 1 of the present invention comprises a dielectric housing 10, a U-shaped stationary switch contact 20 located at a rear end of the housing 10, a moveable switch contact 30 located along a lateral side of the housing 10, a conductive pin 40 longitudinally accommodated in the housing 10, and a metal spring member 50 secured at an underside of the housing 10.

Figure 6:
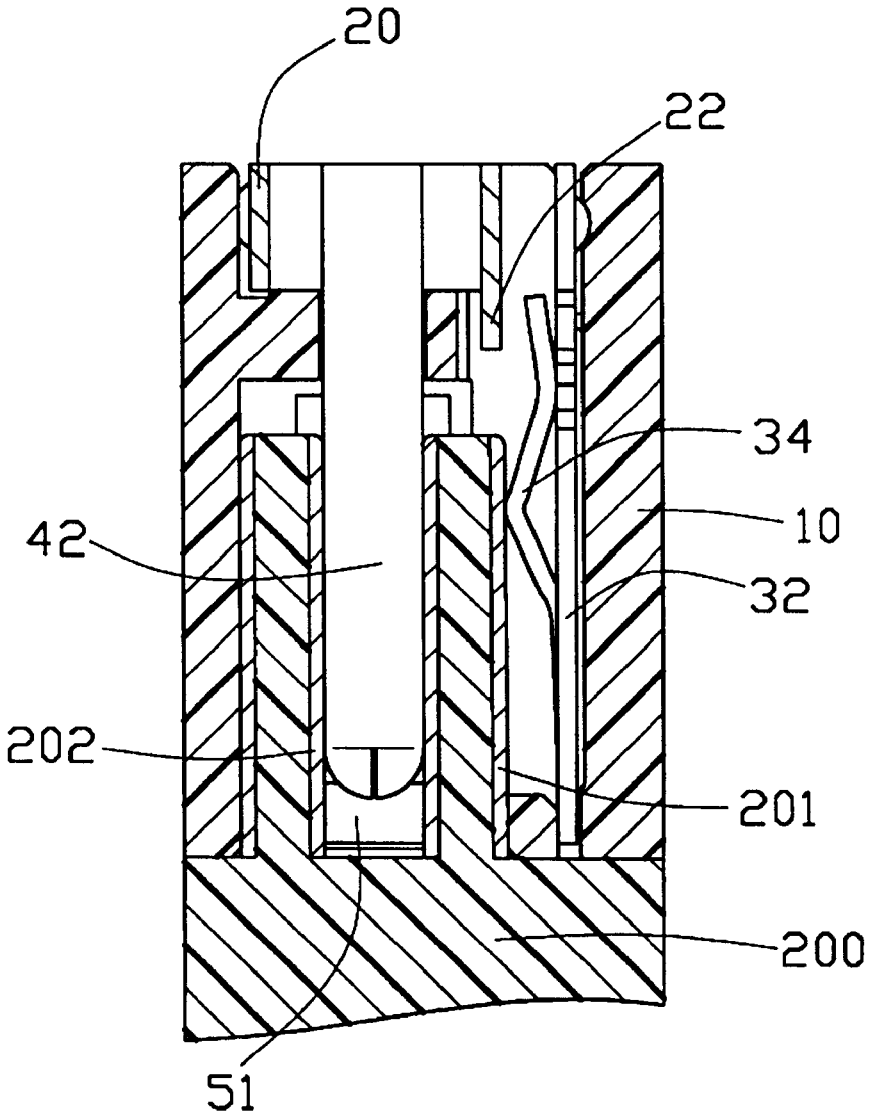
FIG. 6 is similar to FIG. 5, showing a complementary connector inserted in the power jack.
Figure 7:
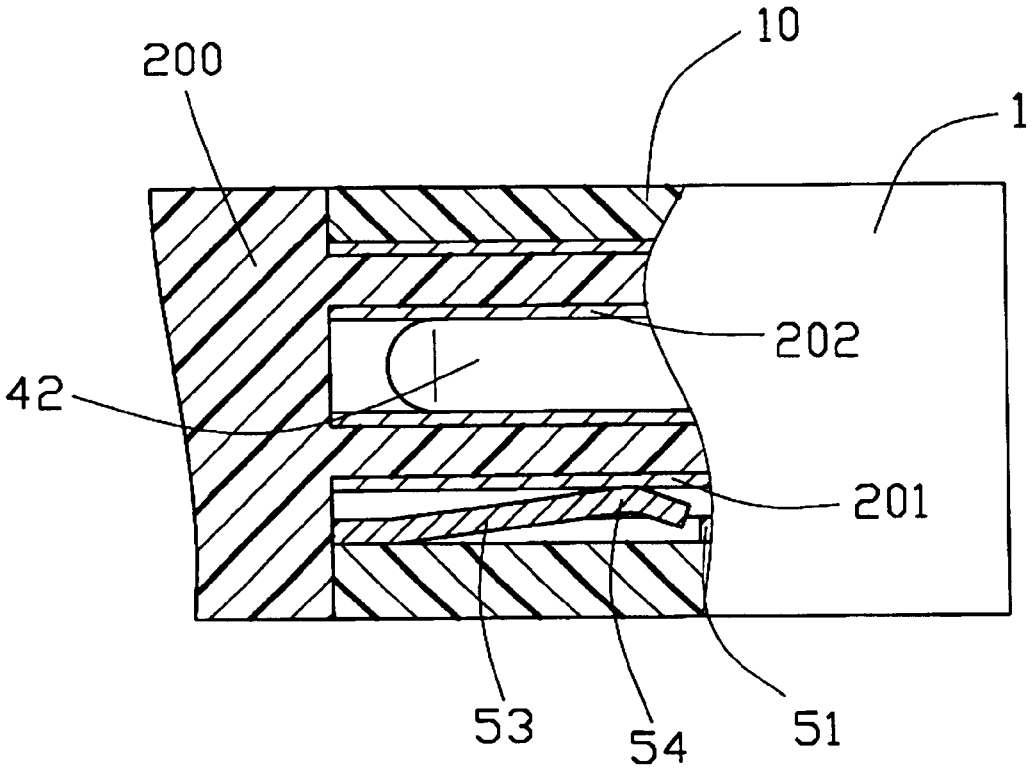
FIG. 7 is a sectional view of FIG. 6 taken along line 7—7, showing a complementary connector inserted in the power jack.

The housing 10 has a tube-like first chamber 121, a slot-shaped second chamber 123 in communication with a bottom of the first chamber 121, a box-like third chamber 125, and a slot-like fourth chamber 127. The first chamber 121 extends from a front surface 101 to a point near the rear surface 103, for receiving a complementary connector 200 (see FIGS. 6 and 7). The second chamber 123 is shaped to accommodate the spring member 50, and is in communication with the first chamber 121 such that the spring member 50 can extend into the first chamber 121 when the spring member 50 is inserted into the second chamber 123. The third chamber 125 is defined in the rear surface 103 of the housing 10, and communicates with the fourth chamber 127 located at a side of the housing 10.

A first slot 131 is defined in a rear portion of a bottom surface 18 of the housing 10, extending inward whereby it communicates with a rear portion of the first chamber 121. A third slot 135 of the third chamber 125 communicates with the bottom surface 18 of the housing 10. A fourth slot 137 of the fourth chamber 127 communicates with the bottom surface 18 of the housing 10.

The pin 40 includes a conventional contacting section 42 at a forward end thereof, a securing section 44 depending perpendicularly from the rear portion of the pin 40, and a dogleg solder tail 46 depending vertically from the securing section 44.

The stationary switch contact 20 includes a horizontal bridge 24, a contact portion 22 depending vertically from a side edge of the bridge 24, and a solder tail 26 depending vertically from an opposite side edge of the bridge 24. An opening 28 is defined by space surrounded by the bridge 24, contact portion 22, and solder tail 26.

The moveable switch contact 30 consists of a planar body 32 and an arm 34 protruding rearward and inward from a front edge of the planar body 32. The arm 34 can resiliently engage with a complementary connector 200 inserted into the first chamber 121 (see FIGS. 6 and 7). A solder tail 38 depends from near a rear edge of the planar body 32, for soldering to a panel or circuit board (not shown) on which the power jack is mounted. A plurality of barbs 36 is formed on opposite upper and lower edges of the planar body 32, for securing the planar body 32 in the fourth chamber 127.

The spring member 50 includes a planar base 51 with a through hole 52 defined therein, and a resilient finger 53 extending rearward and upward from a forward end of the base 51. The finger 53 is stamped from the base 51 and forms a curved engaging section 54 at a free end thereof, shown in FIGS. 6 and 7, for resiliently engaging with a leading portion of the complementary connector 200. A plurality of embossments 55 is formed on lateral sides of the base 51 for securing the base 51 in the second chamber 123. The spring member 50 further provides a pair of nubs 57 on a forward end of the base 51 for preventing vertical movement of the base 51 within the second chamber 123.

Figure 3:
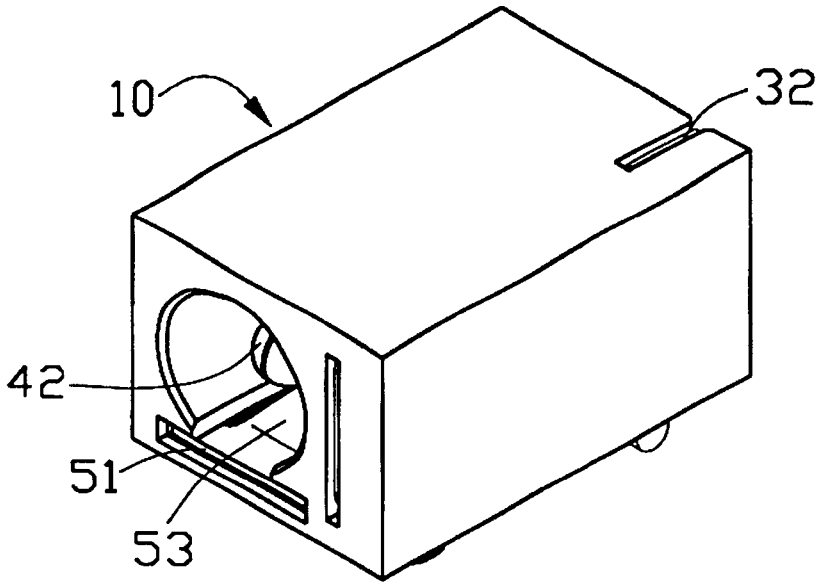
FIG. 3 is a perspective view of an assembled power jack of FIG. 1.
Figure 4:
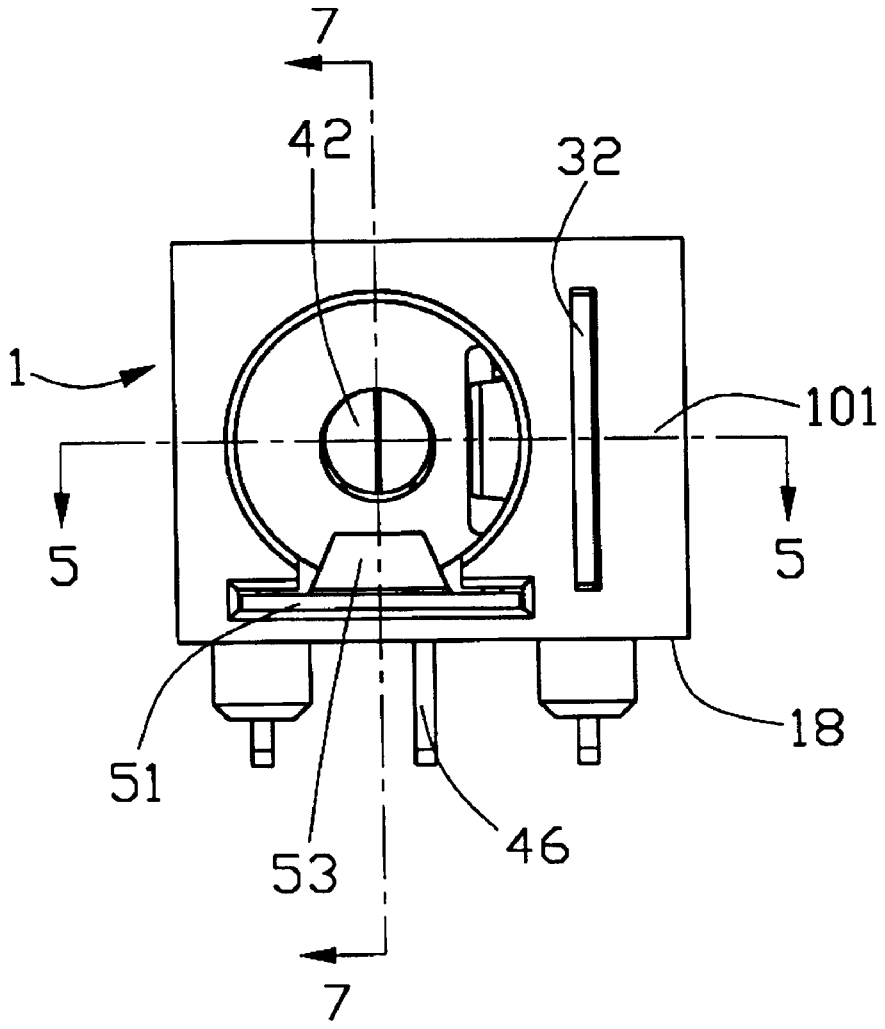
FIG. 4 is a front view of FIG. 3.
Figure 5:
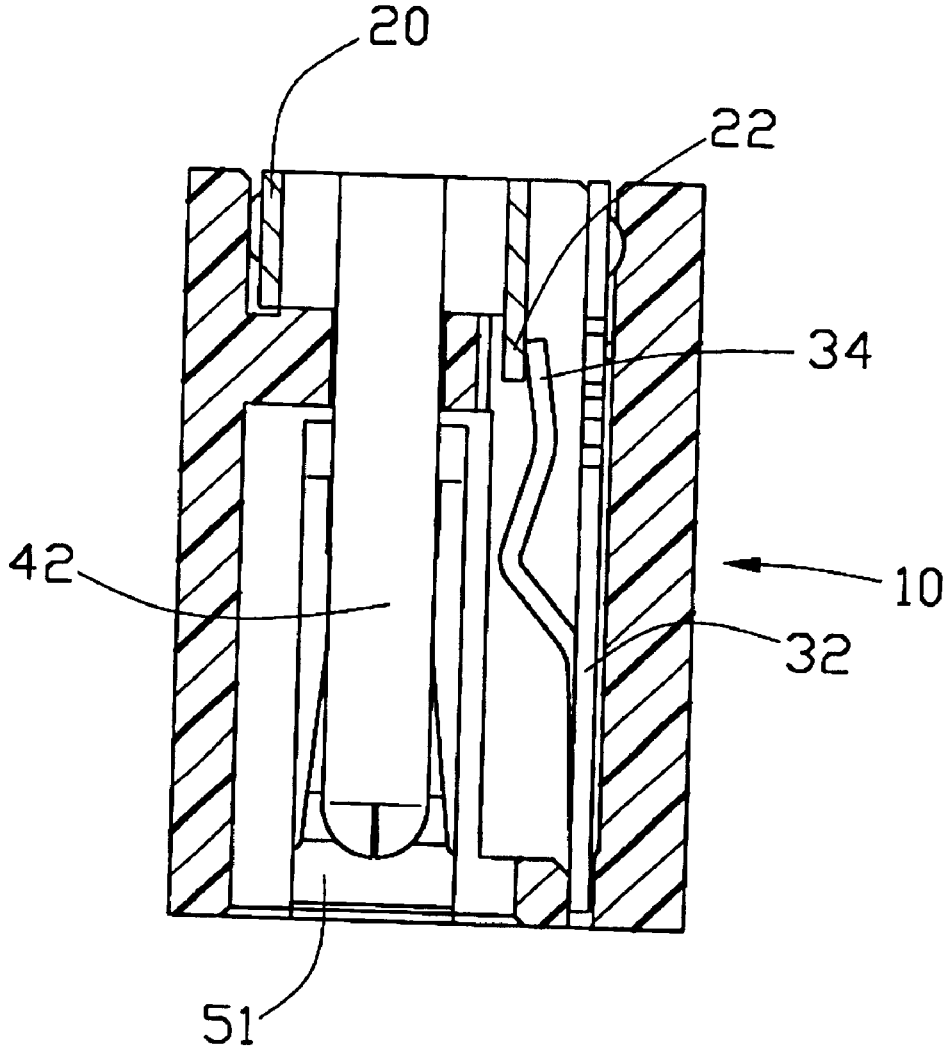
FIG. 5 is a cross-sectional view of FIG. 4 taken along line 5—5.

Also referring to FIGS. 3, 4 and 5, in assembly, the pin 40 is inserted into the first chamber 121, with the solder tail 46 protruding from a bottom surface 18 of the housing 10 and with the securing section 44 being engaged in the first slot 131 of the housing 10. The solder tail 46 is adapted to be soldered into a printed circuit board (not shown), on which the connector 1 is mounted. The stationary switch contact 20 is then positioned in the third chamber 125 so that the securing section 44 of the pin 40 is received within the opening 28 of the stationary switch contact 20. A rear end of the pin 40 is surrounded by the stationary switch contact 20, thereby reducing the overall dimensions of the housing 10. The solder tail 26 of the stationary switch contact 20 now protrudes from the bottom surface 18 of the housing 10 below the third slot portion 135 for soldering into the printed circuit board (not shown). The moveable switch contact 30 is now inserted into the fourth chamber 127 whereby the arm 34 of the moveable switch contact 30 protrudes into the third chamber 125 and contacts with the contact portion 22 of the stationary switch contact 20, for establishing an electrical path therebetween (see FIG. 5). The arm 34 of the moveable switch contact 30 extends into the first chamber 121 for contacting with a shield 201 of the inserted complementary connector 200 (see FIG. 6). The solder tail 38 of the movable switch contact 30 now protrudes from the bottom surface 18 of the housing 10 below the fourth slot portion 137, for soldering into the printed circuit board (not shown). Finally, the spring member 50 is inserted rearwardly into the second chamber 123 such that the base 51 is secured in the second chamber 123 while the finger 53 of the spring member 50 protrudes into the first chamber 121.

When the complementary connector 200 is fully received into the first chamber 121, the arm 34 of the moveable switch contact 30 is pushed away and separated from the contact portion 22. Accordingly, the moveable switch contact 30 cooperating with the stationary switch contact 20 functions as a switch. The pin 40 establishes an electrical connection with the terminal 202 of the complementary connector 200. The engaging section 54 of the finger 53 then presses against the shield 201 of the inserted complementary connector 200 (see FIG. 7). The embossments 55 and the nubs 57 of the spring member 50 provide interferential engagement with the housing 10, for securely retaining the spring member 50 in position.

Since the spring member 50 is insulated within the second chamber 123 of the dielectric housing 10, the finger 53 of the spring member 50 establishes a mechanical connection with the inserted complementary connector 200, without any electrical function. Moreover, the finger 53 applies an upward force on the inserted complementary connector 200, thereby helping to complete reliable electrical connection between the terminal 202 and the pin 40 and increasing the normal force between the complementary connector 200 and the power jack 1. As a result, electrical performance is improved and the possibility of accidental withdrawal of the complementary connector 200 is minimized.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a complementary connector, comprising:

an insulative housing defining a first chamber extending inward from a front surface of the housing, a second chamber adjacent to and communicating with the first chamber, a third chamber, and a fourth chamber adjacent to and communicating with the third chamber;

a pin extending along the first chamber for electrically engaging with the inserted complementary connector;

a stationary switch contact received in the third chamber;

a moveable switch contact received in the fourth chamber and being adapted to switch from connecting with the stationary switch contact before insertion of the complementary connector to separating from the stationary switch contact after insertion of the complementary connector; and a spring member received in the second chamber, the spring member providing an engaging section extending into the first chamber for pressing against the inserted complementary connector;

wherein the spring member includes a base fixed in the second chamber and a finger protruding from the base into the first chamber for engaging with the inserted complementary connector;

wherein the engaging section is formed on a free end of the finger for resiliently pressing against the inserted complementary connector;

wherein the base forms a plurality of embossments for securing the base in the second chamber;

wherein the base form at least a nub for engaging with a side of the second chamber of the housing, thereby preventing perpendicular movement of the base.

* * * * *